United States Patent [19]

Parlman et al.

[11] 4,313,738

[45] Feb. 2, 1982

[54] SUBSTITUTED DIHYDRO OXAZINES AS HYDROCARBON ANTIOXIDANTS

[75] Inventors: Robert M. Parlman; Lyle D. Burns, both of Bartlesville, Okla.

[73] Assignee: Phillips Petroleum Co., Bartlesville, Okla.

[21] Appl. No.: 140,274

[22] Filed: Apr. 14, 1980

[51] Int. Cl.[3] ..... C10L 1/14

[52] U.S. Cl. ..... 44/63; 252/51.5 R; 252/403

[58] Field of Search ..... 252/51.5 R; 44/63, 75

[56] References Cited

U.S. PATENT DOCUMENTS

| | | | |
|---|---|---|---|
| 2,897,182 | 7/1959 | de Benneville et al. | 252/51.5 R X |
| 2,997,469 | 8/1961 | Heel et al. | 252/51.5 R X |
| 3,248,394 | 4/1966 | Andreades | 252/51.5 R X |
| 3,310,554 | 3/1967 | Braun | 252/51.5 R X |
| 3,846,419 | 11/1974 | Seeliger et al. | 260/244 R |
| 3,873,495 | 3/1975 | Appel et al. | 260/42.29 |
| 4,102,798 | 7/1978 | Ryer et al. | 252/51.5 R X |
| 4,153,566 | 5/1979 | Ryer et al. | 252/51.5 R X |

OTHER PUBLICATIONS

Aldrich Chem. Co., 1979–1980 Catalog, p. 323.

Meyers et al., J. Org. Chem., vol. 38, No. 1, (1973), pp. 36–56.

*Primary Examiner*—Andrew Metz

[57] ABSTRACT

Hydrocarbon lube oil or hydrocarbon fuel for a combustion engine containing an amount of substituted dihydro oxazine sufficient to stabilize the hydrocarbon lube oil or hydrocarbon fuel against oxidative deterioration. A method for stabilizing either hydrocarbon lube oil or hydrocarbon fuel for a combustion engine against oxidative deterioration in which an oxidation stabilizing amount of substituted dihydro oxazine is added to the lube oil or the hydrocarbon fuel.

4 Claims, No Drawings

SUBSTITUTED DIHYDRO OXAZINES AS HYDROCARBON ANTIOXIDANTS

BACKGROUND OF THE INVENTION

This invention relates to hydrocarbon fuels for combustion engines or hydrocarbon lubricating oils. In one of its aspects this invention relates to increasing the oxidation resistance of hydrocarbon fuels and hydrocarbon lubricating oils. In another of its aspects this invention relates to compositions stabilized against oxidative deterioration that are useful as fuel for a combustion engine or as lubricating oil.

Cracked gasolines, polymer gasolines and blends containing these gasolines are unstable and tend to undergo deterioration. This difficulty is believed to be due to the presence in the gasoline of constituents which are subject to oxidative changes resulting in the formation of gums and color-imparting bodies. Gasolines containing these constituents while in contact with air, on standing or in use, form nonvolatile resinous or gummy substances which tend to form coatings in feed lines, carburetor parts, valves, valve stems, etc. with the result that the gasoline is reduced in value as a motor fuel. It is of economic importance to have gasolines that will resist oxidation thereby eliminating or greatly retarding the formation of undesirable resinous by-products.

Lubricating oil compositions are also afflicted with deterioration problems caused by the presence of constituents which undergo oxidative changes to form gums and color-imparting bodies. In general, lubricants exhibit the quality of "thickening" as a manifestation of the oxidative changes. It is, therefore, of great economic importance to have lubricating oils that can resist oxidation and its consequent problems.

Substituted phenylenediamines have long been regarded as satisfactory antioxidants for hydrocarbon fuels such as gasoline. Some of these materials or their decomposition products have been alleged to have adverse affects on humans and are, therefore, being phased out of use. This invention provides stabilized gasoline and lubricating compositions by the use of an alternative additive.

It is therefore an object of this invention to provide a method for stabilizing hydrocarbon fuels and lubricating compositions. It is also an object of this invention to provide lubricating compositions and hydrocarbon fuel compositions that are stabilized against oxidative decomposition.

Other aspects, objects, and the various advantages of this invention will become apparent upon reading this specification and the appended claims.

STATEMENT OF THE INVENTION

According to this invention hydrocarbon lubricating oils and hydrocarbon fuel for combustion engines containing an amount of substituted dihydro oxazines sufficient to stabilize the compositions against oxidative deterioration are provided.

In an embodiment of the invention a method for stabilizing hydrocarbon lubricating oils and hydrocarbon fuel for combustion engines against oxidative deterioration is provided in which a stabilizing amount of substituted dihydro oxazine is admixed with the compositions.

Dihydro oxazines useful in this invention as antioxidants are those materials represented by the formula

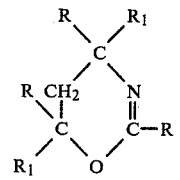

wherein R can be any saturated hydrocarbyl radical having from 1 to 18 carbon atoms and $R_1$ can be hydrogen or R and wherein each R or $R_1$ can be the same or different. Such compounds are generally prepared according to procedures described in U.S. Pat. No. 3,846,419 and J. Org. Chem., Vol. 38, No. 1, 1973. Among representative compounds are: 5,6-dihydro-2,4,6-trimethyl-4H-1,3-oxazine, 5,6-dihydro-2,4,4,6-tetramethyl-4H-1,3-oxazine, 5,6-dihydro-2,4,4,6,6-pentamethyl-4H-1,3-oxazine, 5,6-dihydro-2-dodecyl-4-ethyl-6-methyl-4H-1,3-oxazine, 5,6-dihydro-2-octadecyl-4,4,6-trimethyl-4H-1,3-oxazine, 5,6-dihydro-2-cyclohexyl-4,4,6-trimethyl-4H-1,3-oxazine, 5,6-dihydro-2-cyclohexyl-4,6-diphenyl-4H-1,3-oxazine, 5,6-dihydro-2,4-dimethyl-4,6-didodecyl-4H-1,3-oxazine, 5,6-dihydro-2-benzyl-4,4,6-trimethyl-4H-1,3-oxazine, and the like.

A concentration of this type of compound when present in lubricating oil or unleaded gasoline from about 1 weight percent (10,000 ppm-parts per million) to about 0.0001 weight percent (1 ppm) is effective as an antioxidant. The preferred range of addition is from about 0.1 weight percent (1000 ppm) to about 0.0002 weight percent (2 ppm).

Hydrocarbon fuels with which oxazine compounds are effective antioxidants are unleaded mixtures, i.e., those containing less than 0.05 weight percent lead. Based on evidence that olefins are the main constituent in gasoline that form gummy residues or discoloration the types of hydrocarbon fuels with which this invention is of particular use are any materials containing from 0.1 to 50 weight percent olefins. These materials include cracked gasolines, polymer gasolines, and the like. Lubricating oils, greases, fluids, etc. are also within the scope of compositions with which this invention is useful providing they contain constituents that discolor or form gummy residues upon exposure to oxygen.

The hydrocarbon fuel used in the examples below is of the gasoline type to which the invention is primarily directed. This fuel can contain varying amounts of paraffins, olefins, cycloparaffins (naphthenes) and aromatics but little, if any, metals for instance less than 0.05 weight percent lead. General specifications for this type gasoline are set forth in ASTM D439-56T. The amount of volatilizing agent employed will vary to meet specific requirements due to seasons and geographical locations. The characteristics and properties of the unleaded gasoline employed in the examples herein are listed as follows:

| Designation | FT-116[a] |
|---|---|
| Reid Vapor Pressure, psi | 7.0 |
| API Gravity @ 60° F. (15.6° C.) | 64.4 |
| ASTM Distillation | |
| Vol. % Evaporated | Temp. °F. |
| IBP | 88 |
| 5 | 113 |
| 10 | 130 |
| 15 | 143 |

-continued

| | |
|---|---|
| 20 | 154 |
| 30 | 176 |
| 40 | 196 |
| 50 | 214 |
| 60 | 234 |
| 70 | 252 |
| 80 | 290 |
| 90 | 347 |
| 95 | 384 |
| EP | 414 |
| Lead Content, g/gal | 0.02 |
| Sulfur Content, wt. % | 0.28 |
| Research Octane Number (RON) | 92.0 |
| Motor Octane Number (MON) | 84.9 |
| Component | Vol. % |
| Paraffins | 68.1 |
| Olefins | 16.3 |
| Naphthenes | 4.04 |
| Aromatics | 11.55 |
| Average Molecular Weight | 100.2 |
| Atomic Ratio: Hydrogen/Carbon | 2.08 |
| Stoichiometric Air-Fuel Ratio | 14.86 |

[a]Unleaded Kansas City Premium Pipeline Base Gasoline from Phillips Petroleum Co.

The following examples serve to illustrate the operability of the invention.

EXAMPLE I

This is a control run illustrating the oxidation stability of an unleaded gasoline fuel in the absence of an antioxidant. ASTM D524-74, "Oxidation Stability of Gasoline (Induction Period Method)" was the standard test employed for determining oxidation stability (oxygen resistance). Briefly, the method consists of placing 50±1 milliliters of gasoline in a glass sample container which is positioned in a steel bomb. The bomb is sealed, pressured to 100 to 102 psi (689 to 703 kPa) with oxygen and placed in a 208°–216° F. (98°–102° C.) water bath. The time is then noted for which within the last previous 15 minute interval a pressure drop of exactly 2 psi (13.8 kPa) has occurred. A base fuel, FT-116 KC (characterized above) was tested as described above in the absence of antioxidant. This fuel was determined to have an induction period of 2 hours and 15 minutes.

EXAMPLE II

This example demonstrates the results obtained when the inventive oxazine additive and a commercial control antioxidant are employed as additives for gasoline. These results show the inventive compound performs nearly as well as the commercial compound. The procedure described in Example I was twice repeated, once with 5,6-dihydro-2,4,4,6-tetramethyl-4H-1,3-oxazine present and then with the commercial antioxidant N,N'-di-sec-butyl-phenylenediamine (AO-22), present. In each test, 0.2 grams of the additive to be tested was dissolved in 1000 milliliters of gasoline and 1 milliliter of this solution was diluted with 433 milliliters of the same gasoline. This is equivalent to about 0.0005 weight percent (5 ppm) or 1.4 pounds of additive per 1000 barrels of gasoline. The induction periods were as follows: 3 hours and 20 minutes for the oxazine additive and 3 hours and 45 minutes for the commercial additive.

The data herein disclosed are summarized in Table I pointing out that the inventive oxazine additive significantly improves the oxidation stability of unleaded gasoline over the stability when no additive is present. The data also show the oxazine additive to be of the same range of effectiveness as the commercial phenylenediamine antioxidant in performance when employed at the same concentration.

TABLE I

Summary of Effect of Antioxidant on Stability of Unleaded Gasoline[1]

| Example No. | Antioxidant[2] | Time to Reach a Pressure Drop of 2 psi Within 15 Min. Interval[3] |
|---|---|---|
| I | No additive | 2 hrs. 15 mins. |
| II | AO-22[4] | 3 hrs. 45 mins. |
| III | 5,6-Dihydro-2,4,4,6-tetramethyl-4H-1,3-oxazine[5] | 3 hrs. 20 mins. |

[1]Unleaded premium base pipeline gasoline, FT-116 KC (Phillips Petroleum Co.) comprised of 68 weight percent paraffins, 16.3 weight percent olefins, 4 weight percent naphthenics, 11.55 weight percent aromatics.
[2]0.0005 weight percent (1.4 lbs/1000 bbl.)
[3]ASTM D525-46
[4]N,N'-Di-sec-butylphenylenediamine
[5]Available from Aldrich Chemical Co.

We claim:

1. A hydrocarbon composition suitable as a fuel for combustion engines comprising a hydrocarbon fuel and an amount of substituted dihydro oxazine in the range of about 1 weight percent to about 0.0001 weight percent sufficient to stabilize said fuel against oxidative deterioration.

2. A composition of claim 1 wherein said dihydro oxazine is represented by the formula

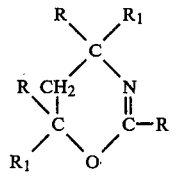

wherein R is any saturated hydrocarbyl radical having from 1 to 18 carbon atoms and $R_1$ is hydrogen or R and wherein each R or $R_1$ is the same or different and wherein said substituted dihydro oxazine is present in the composition in a range of about 0.1 weight percent to about 0.0002 weight percent.

3. A method for stabilizing a hydrocarbon fuel for combustion engines comprising admixing with said hydrocarbon fuel an amount of substituted dihydro oxazine in the range of about 1 weight percent to about 0.0001 weight percent sufficient to stabilize said hydrocarbon fuel against oxidative deterioration.

4. A method of claim 3 wherein said substituted dihydro oxazine is represented by the formula

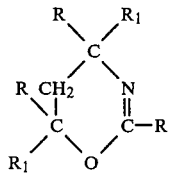

wherein R is any saturated hydrocarbyl radical having from 1 to 18 carbon atoms and $R_1$ is hydrogen or R and wherein each R or $R_1$ is the same or different and wherein said substituted dihydro oxazine is present in the composition in a range of about 0.1 weight percent to about 0.0002 weight percent.

* * * * *